United States Patent [19]

Kline

[11] 3,997,146

[45] Dec. 14, 1976

[54] MATERIAL ADVANCING MEANS FOR A GRINDER-MIXER

[75] Inventor: Charles M. Kline, Reinholds, Pa.

[73] Assignee: Sperry Rand Corporation, New Holland, Pa.

[22] Filed: Feb. 23, 1976

[21] Appl. No.: 660,602

[52] U.S. Cl. ..... 259/8; 259/97

[51] Int. Cl.[2] ..... B01F 5/12; B01F 7/24

[58] Field of Search ..... 259/6, 7, 8, 21-24, 259/41-44, 97; 241/101 B, 101.5, 101.6

[56] References Cited

UNITED STATES PATENTS

| | | | |
|---|---|---|---|
| 1,576,018 | 3/1926 | Wolf | 259/97 X |
| 1,734,632 | 11/1929 | Merrill | 259/43 X |
| 2,896,923 | 7/1959 | Luscombe | 259/8 |
| 3,369,762 | 2/1968 | Buzenberg et al. | 241/63 |
| 3,589,684 | 6/1971 | Dixon | 259/97 |
| 3,667,734 | 6/1972 | Skromme et al. | 259/44 |
| 3,780,993 | 12/1973 | Kline | 259/97 |
| 3,840,189 | 10/1974 | Kanengieter et al. | 241/101 B X |

OTHER PUBLICATIONS

"Brady Hydra-Mills", Brochure No. 15D472NWC, Koehring Farm Division.

*Primary Examiner*—Philip R. Coe
*Attorney, Agent, or Firm*—Frank A. Seemar; John R. Flanagan; Michael R. Swartz

[57] ABSTRACT

Mixing apparatus having a frame on which a vertical mixing tank is mounted. A hammermill, carried on the frame, receives and chops different types of feed material. A transfer conveyor receives the resulting product and transports it to the mixing tank. Additives or other feed materials may be transferred to the tank via a secondary conveyor. A mixing assembly within the tank circulates material deposited therein to produce a well mixed homogeneous mass. The mixing assembly includes upper and lower material advancing portions, the lower of which comprises a conical shaped core member converging upwardly. Unique flighting is wound around this core member to elevate crop material to the upper material advancing portion. The width of the flighting increases as it advances upwardly to enhance the effectiveness of the mixing assembly. The pitch of the flighting may also be increased as it advances upwardly.

13 Claims, 5 Drawing Figures

MATERIAL ADVANCING MEANS FOR A GRINDER-MIXER

CROSS REFERENCES TO RELATED APPLICATIONS

Reference is hereby made to the following co-pending U.S. applications dealing with related subject matter, assigned to the assignee of the present invention and filed on or on about the same date as the present application: 1. "Improved Feed Material Mixing Apparatus", Charles M. Kline and Thomas W. Waldrop, Ser. No. 660,204, filed Feb. 23, 1976. 2. "Feed Material Mixing Apparatus", Charles M. Kline and Thomas W. Waldrop, Ser. No. 660,212, filed Feb. 23, 1976.

BACKGROUND OF THE INVENTION

The present invention relates to an agricultural grinder-mixer, and more particularly, to a mixing tank configuration having an improved internal mixing assembly for augmenting proper circulation of material contained in the tank.

On most present day grinder-mixers a vertical mixing assembly is mounted within a vertical mixing tank having a cylindrical upper portion and a conical downwardly converging lower portion. The mixing assembly includes a centrally located upright mixing auger rotatably mounted within a tubular housing. An inlet is provided in the housing at its lower end and a discharge opening is provided at the top of the housing. During a mixing operation, material is conveyed in a generally circuitous path, i.e., material is continually transferred from the bottom of the tank upwardly through the auger housing to the top of the tank whereupon it is discharged through the opening and allowed to gravitate back down. Commercially available apparatus of this type is illustrated by U.S. Pat. No. 3,780,993, issued Dec. 25, 1973, to Charles M. Kline, the inventor of the present invention.

The conical portion of the grinder-mixer tank described above functions to direct material inwardly towards the central mixing auger as it settles or gravitates downwardly during circulation. Since the horizontal cross section of the tank decreases substantially as the walls converge inwardly, the material is compressed as it settles causing certain crop materials, especially under moist and/or extremely tough conditions, to form a cluster of relatively solid material. This is illustrative of a problem commonly encountered during operation of tanks having a conventional conical shaped lower portion. Material moving downwardly during a mixing operation tends to build up in the area between the lower walls of the tank and the outer surface of the auger housing. This buildup, commonly referrred to as "bridging", restricts free downward flow of material and thereby impedes the circuitous flow of material and diminishes effectiveness of the central mixing auger. Certain crop conditions lead to more frequent bridging and many times shutdown is necessary to permit manual removal of material from plugged areas.

One prior art arrangement devised to overcome the problem of bridging in the lower tank is shown in U.S. Pat. No. 3,780,993 mentioned above. In this arrangement, the central mixing auger is provided with a lower flighting section having relatively wider outside dimensions. This configuration is designed to increase the volume of material displaced per revolution and thereby more effectively circulate material in the tank. Although this type of auger has been generally successful, the overall efficiency drops off under certain crop conditions due to shortcomings stemming from the conical configuration of the tank. This patent also disclose an auger having a plurality of elements extending outwardly from the edge of the lower flighting. As the central mixing auger is rotated, the extensions engage and agitate surrounding material to break up clusters of material in the vicinity of the auger and permit the material to gravitate more freely to the base of the tank. Consequently, the extensions further enhance overall circulation of feed material within the tank during a mixing operation. Although this feature generally improves mixing capability under adverse conditions, it is not entirely satisfactory in that it tends to create turbulence during circulation of dry crop materials peculiar to certain geographical regions.

Another prior art approach to the problem of bridging in the lower tank portion of grinder-mixers is disclosed in U.S. Pat. No. 3,667,734, to A. D. Skromme et al, issued June 2, 1972. In this patent, the tank walls of the grinder-mixer are vertical and when material gravitates to the bottom of the mixing chamber during operation, it is engaged by the blade of a long sweep arm rotating with and extending outwardly from the mixing auger shaft. The arm sweeps across a path parallel to and encompassing the entire bottom of the tank. A similar sweep arm is employed in the vertical mixing tank disclosed in U.S. Pat. No. 1,576,018, issued Mar. 9, 1926, to R. B. Wolf. In this type of apparatus the tendency of material to wedge under the sweep arm causes an upward force component with obvious deleterious effects. While this problem is partly alleviated by a guide used to restrain the outer end of the sweep arm, it is conceivable that this could compound the problem due to the tendency to bridge between the sidewall and any ledge-like extension from the wall into the tank. A further shortcoming of a vertical sidewall type configuration is the inherent need for a head of pressure, without which the arm has a tendency to merely slide under the material without changing its relative position in the tank, as is the situation during partial load conditions. This disadvantage becomes more critical at the end of an unloading operation when the decreased weight of the load reduces the sweep arm's ability to urge material toward an unloading port. Thus, the sweep arm seemingly operates best under full load conditions but conversely as the load increases the effects of wedging become more pronounced.

There exists still another prior art approach to the problem of bridging in grinder-mixers having an inverted conical shaped lower tank portion inclined inwardly for guiding material toward a centrally located mixing assembly. For example, apparatus is sold by the Koehring Farm Division of Des Moines, Iowa, wherein the mixing assembly comprises a cylindrical auger mounted for rotation with a lower auger portion having an inverse frusto-conical shaped core. In this arrangement the inclined wall commences at the approximate center of the tank and the bottom of the tank is completely covered by the lower core section as shown in Koehring brochure No. 15D472 NWC. A similar configuration is disclosed in U.S. Pat. No. 3,589,684, issued on June 29, 1971, to Bernard Dixon. The Dixon patent also shows a mixing tank with a vertical mixing assembly having a frusto-conical shaped lower core section on a common shaft with an upper cylindrical auger. The upper and lower augers are coaxially journalled in the tank for rotation within a housing that is flared at the bottom in a shape adapted to accommodate the conical portion of the lower auger. In Koehring the auger tube does not include a flared portion at the lower end thereof, and thereby exposes the conical portion of the auger to material being guided along the tank wall.

In the Dixon arrangement, even though the flared enclosure has slotted apertures, the conical portion of the housing would tend to cause bridging between it and the tank wall due to the convergence of gravitating material with no means to rapidly take it away. Bridging problems are exceptionally acute under conditions where crop material is damp as is the case in many areas of the world where grinder-mixers are employed. In the Koehring arrangement without a flared housing portion, even though material is allowed to contact the conical portion of the auger prior to reaching the bottom of the tank, the problem of bridging at the area of convergence between the vertical auger housing and the inner surface of the inclined sidewall is not embraced.

SUMMARY OF THE INVENTION

It is, accordingly, the principal object of the present invention to provide a mixing apparatus in which the aforementioned problems of the prior art have been overcome. More particularly, it is an object to provide a machine in which bridging of the feed material during the mixing process is substantially reduced regardless of feed material conditions and the material is more thoroughly and uniformly mixed without increasing turbulence in the mixing tank operation. It is a further object to provide more efficient mixing apparatus by increasing circulation frequency during the mixing process without affecting performance and capacity and which is relatively inexpensive and requires a minimum amount of power.

In pursuance of these and other objects, the present invention contemplates new and improved feed mixing apparatus for use in a grinder-mixer having a tank in which a unique centrally located mixing auger is employed to uniformly circulate feed material during a mixing process.

In one embodiment the mixing apparatus comprises a frame on which a tank is supported having a top, a bottom and outer walls for confining the feed material therewithin during a mixing process. A vertical mixing assembly, centrally mounted in the tank, comprises a vertical auger housing and rotatably mounted material advancing means having a first portion comprising a cylindrical vertical auger positioned partly within the housing and adapted to receive material for advancement upwardly through the housing. A second portion of the material advancing means is disposed below and axially aligned for rotation with the first portion. The second portion of the vertical auger includes a frusto-conical shaped core member converging upwardly and having spiral flighting extending from the outer surface of the core to engage material being mixed. The flighting increases in width from its lower end to its upper end for uniformly advancing material upwardly to the first portion of the auger by maintaining the volume displaced per revolution of the mixing assembly as the radius of the core decreases.

The present invention also contemplates an arrangement whereby the pitch of the flighting on the second portion of the vertical auger increases as the flighting advances upwardly for uniformly advancing material upwardly. The pitch and width of the flighting are varied in a way such that the volume displayed per revolution is maintained at a relatively constant level to enhance uniform circulation characteristics and minimizes auger tube plugging.

The foregoing and other objects, features and advantages of the invention will appear more fully hereinafter from a consideration of the detailed description which follows, in conjunction with the accompanying sheets of drawings wherein one principle embodiment of the invention is illustrated by way of example. It is to be expressly understood, however, that the drawings are for illustrative purposes and are not to be construed as defining the limits of the invention.

DESCRIPTION OF THE PREFERRED EMBODIMENT

Figure 1:
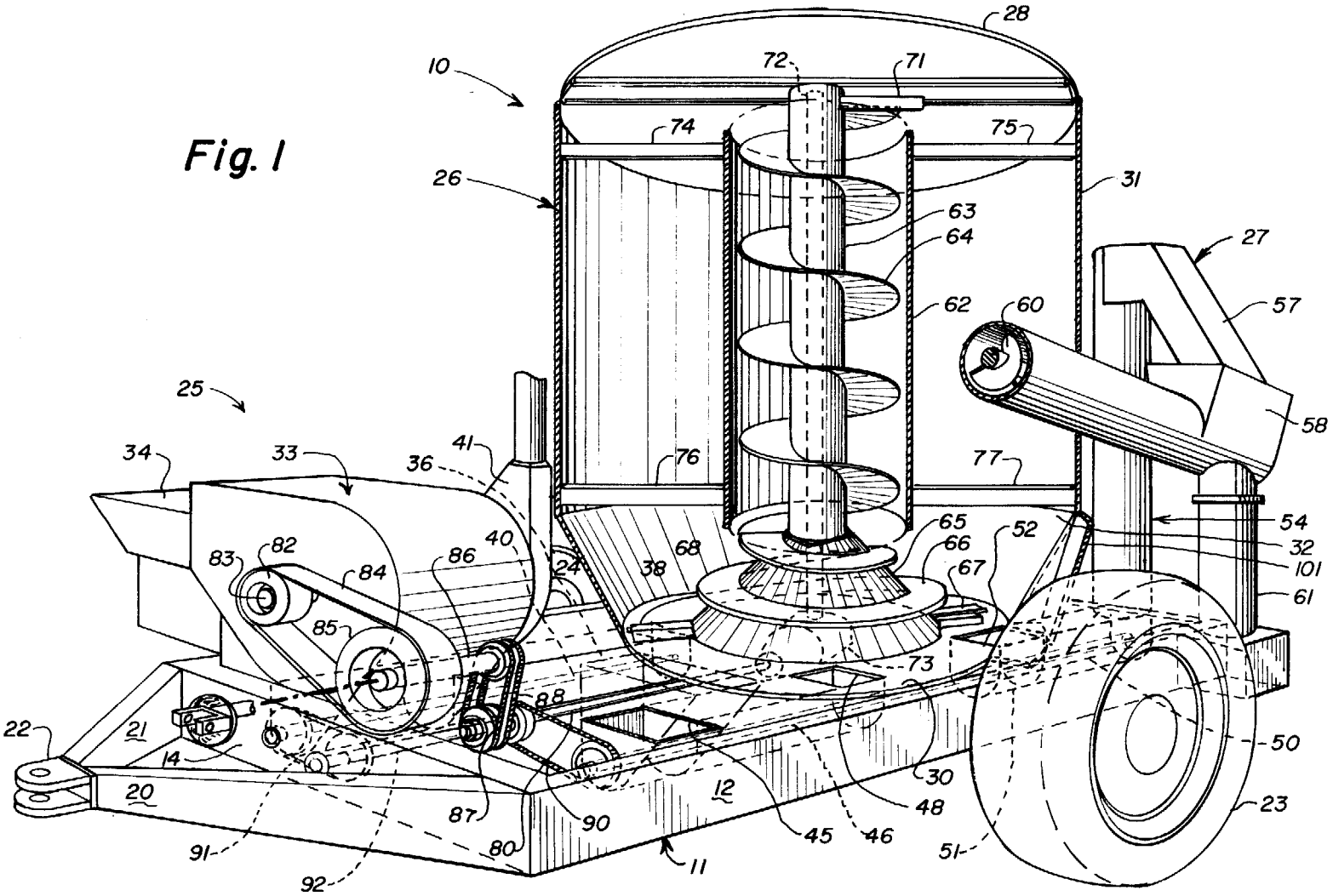
FIG. 1 is a diagrammatic perspective view of a portable grinder-mixer with portions cut away to illustrate a machine in which the present invention may be embodied.

Referring to the drawings for a more detailed description, a grinder-mixer, generally designated by reference numeral 10, is shown in FIG. 1 to illustrate by way of example one embodiment of equipment in which the present invention may be employed. The grinder-mixer 10 comprises a generally fore-and-aft main frame 11 having parallel side members 12 and 13, front and rear cross support means 14 and 15, respectively, a plurality of intermediate support members 16, 17 and 18 (see FIG. 2), and forwardly converging members 20 and 21. A clevis 22, formed at the front of converging members 20 and 21, is adapted to be connected to a drawbar of a tractor (not shown) such that the grinder-mixer may be readily towed from one place to another during which ground engaging support is provided by a pair of wheels 23 and 24. Mounted on main frame 11 is an input section 25, a mixing assembly 26 for mixing material received in section 25 and an unloading assembly 27 for unloading mixed material after the mixing operation is completed. The mixing assembly includes a tank having a top 28, a bottom 30 and an outer wall comprising an upper cylindrical section 31 and a lower frusto-conical shaped section 32 extending inwardly and downwardly terminating near bottom 30 of the tank.

The crop input section is disposed forwardly of the tank and includes a hammermill 33 secured to the main frame. The hammermill, not shown in detail, is of a conventional grinder-mixer type which functions to initially grind feed material prior to being transferred to the mixing tank. In the present invention feed material is fed into a hammermill hopper 34 and ground by hammermill 33, including a plurality of rotating hammer elements 35 (shown in phantom in FIG. 3), during which grinding operation a substantial portion of the ground feed is allowed to gravitate into a transfer auger 36 (only partly depicted in FIG. 1) which conveys the ground feed material from hammermill 33 into the mixing tank, via paddles 37 (see FIG. 2) disposed opposite an opening 38 in bottom 30 of the tank. The paddles 37 are mounted on transfer auger shaft 40 and receive material being conveyed in a generally axial direction and throw it upwardly into the tank. That portion of the ground material which is too fine to gravitate into transfer auger 36 is captured in an airstream produced by fan 41 and conveyed upwardly through vertical pipe 42 into a cyclone-type dust collector 43 which functions in a well known manner to centrifugally separate feed material from the air. Feed material separated by dust collector 43 is allowed to gravitate downwardly into the transfer auger 36 via a return pipe 44, shown in FIG. 3 of the drawings, extending vertically along the right side of the cylindrical section of the tank. In this description, right hand and left hand references are determined by standing to the rear of the portable grinder-mixer and facing the direction of conventional travel.

During normal grinder-mixer operation, it is not uncommon to introduce supplemental feed concentrates to the ground material being mixed in the tank. These feed supplements include high protein additives, minerals, salt or the like, depending on the end use. Accordingly, the crop input section is provided with a feed concentrate hopper 45 through which concentrated feed addivites may be selectively introduced. The additives gravitate to the bottom of concentrate hopper 45 and are conveyed via an auxiliary transfer auger 46 and paddles 47, through opening 48 to the tank in a manner similar to that by which material is conveyed to the tank by main transfer auger 36.

Unloading assembly 27 comprises a horizontal discharge auger 50 (only partly depicted in FIG. 1) rotatably mounted in a trough 51 communicating with the tank via opening 52 in bottom 30. The assembly further comprises a vertical discharge auger 53 rotatably mounted within an upright tube 54 communicating at its lowermost end with the rear portion of trough 51. Hereagain radially extending paddles 55 (see FIG. 2) on the shaft of auger 50 assist in the transfer of material from trough 51 to tube 54. Material carried upwardly by vertical discharge auger 53 is thrown outwardly by paddle assembly 56 (see FIG. 3) whereupon it is conveyed downwardly along discharge spout 57 to an unloading auger hopper 58 and thence to an unload auger 60 in communication with such unloading auger hopper. Unload auger 60 and auger hopper 58 are supported by cylindrical housing 61 through which suitable drive means for unload auger 60 are provided. Although not specifically shown, unload auger 60 and unloading auger hopper 58 are pivotally mounted about vertical and transverse axes such that the unload auger 60 is movable sideways and up and down during an unloading operation. The unloading portion of the discharge auger assembly, which does not form a material part of the present invention, can best be appreciated from a study of U.S. Pat. No. 3,638,816 issued Feb. 1, 1972, to William W. Mann and assigned to the assignee of the present application.

Figure 2:
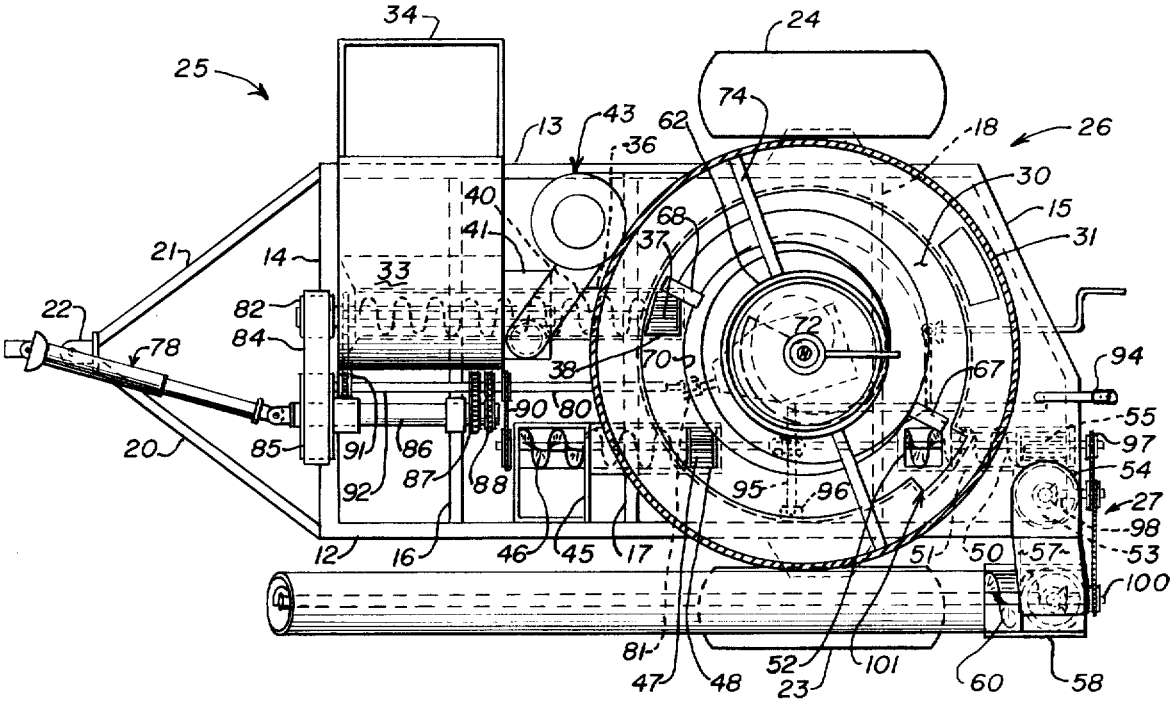
FIG. 2 is a plan view taken along lines 2—2 of FIG. 3.
Figure 3:
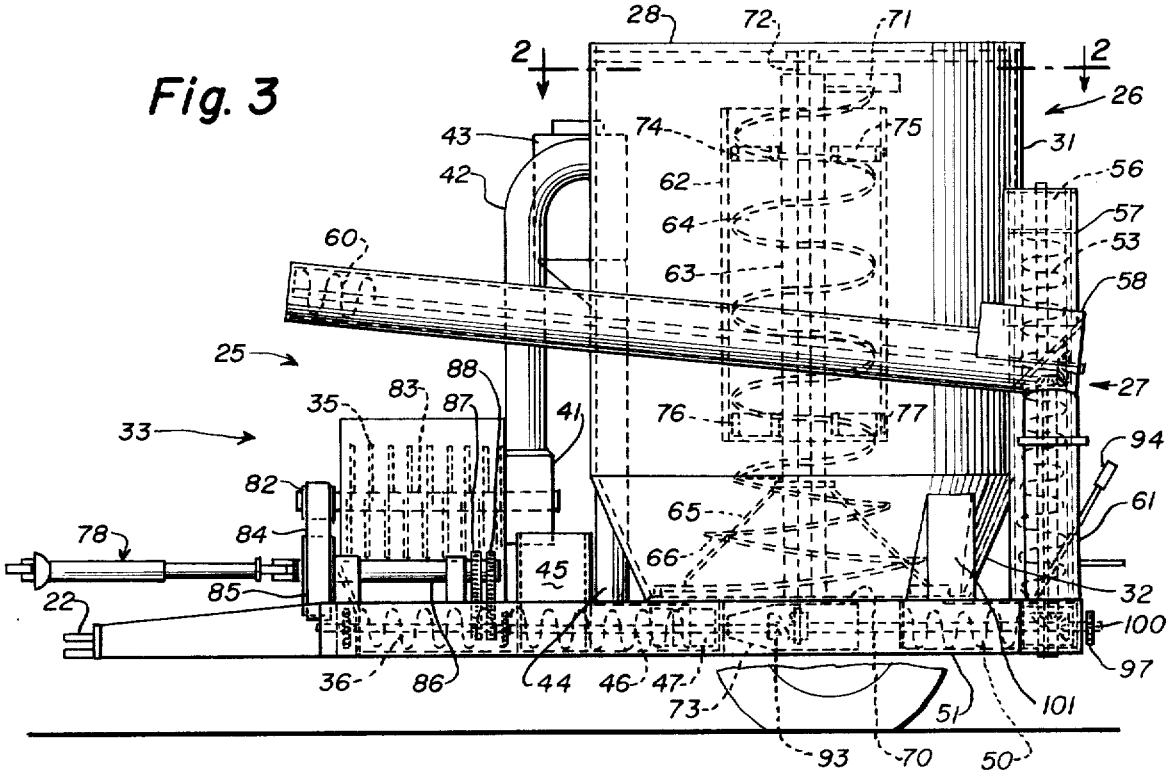
FIG. 3 is a side elevational view of a machine of the tupe illustrated in FIG. 1.

Now turning to mixing asembly 26, centrally located within the tank, it will be noted that it comprises a rotatably mounted material advancing assembly disposed coaxial with a tubular auger housing 62. The material advancing assembly more specifically includes first and second material advancing portions, the first of which comprises a vertical auger having a tubular core 63 and constant pitch spiral flighting 64 extending outwardly therefrom. The second and lowermost portion of the material advancing assembly consists of a frusto-conical shaped core member 65 and spiral flighting 66 wound upwardly and extending outwardly therefrom. Rigid crop engaging elements 67 and 68 extend outwardly from the circular lower edge 70 of the core member 65. The spiral flighting 66 commences from the trailing edge of rigid crop engaging element 68 and increases in pitch and width as it advances upwardly to terminate adjacent the top edge of frusto-conical shaped core member 65. Spiral flighting 64 on the upper portion of the rotatably mounted material advancing assembly commences at the termination of spiral flighting 66 and likewise tubular core 63 commences from and has a like diameter as the circular top edge of core 65. Generally, the rotatably mounted material advancing assembly provides auger flighting wound upwardly from the bottom portion of the mixing tank to the upper portion thereof and, in terms of function, acts to continually advance material from the bottom of the tank to the top. When the material being carried upwardly in housing 62 reaches the top, it is discharged outwardly through the space between auger housing 62 and top 28 which material thereupon gravitates back downwardly toward the lower portion of the tank. As shown in FIGS. 2 and 3, a radially extending paddle 71 is affixed to the top edge of flighting 64 to assist in the discharge of material from housing 62.

Viewing the centrally located vertical mixing assembly in more detail, it will be seen further in FIGS. 2 and 3 that the first and second portions are mounted for rotation on an internally supported upright shaft 72 centrally disposed in the tank. The shaft, rotatably driven via gearbox 73, is journalled in any suitable bearing means within the tank. The vertical auger housing 62 is affixed to the tank by pairs of upper and lower connecting rods 74, 75 and 76, 77, respectively, extending radially between the housing and the inner surface of the upper cylindrical section of the tank.

As seen in FIG. 3, lower frusto-conical shaped section 32 of the tank forms a trough-like area in the bottom of the tank by virtue of its relationship with frusto-conical shaped core 65 of the lower portion of the material advancing assembly. This circular shaped trough is further defined by the exposed ring-shaped portion of the bottom of the tank within the circular intersection between the bottom edge of the frusto-conical shaped wall and the bottom and the concentric projection of the bottom edge of core member 65. The upper limits of such trough are defined by an imaginary horizontal plane through the approximate intersection between the cylindrical section of the tank walls and the lower frusto-conical shaped section of the tank, which plane passes through the material advancing assembly in the general viciniy of intersection between lower frusto-conical core member 65 and tubular core member 63. This trough-like area, which is at the heart of the invention, extends upwardly a distance just less than 25 percent of the total height of the tank, e.e., approximately one-fourth the distance between top 28 and bottom 30. The ring-shaped exposed bottom area, defined by the bottom edge of frusto-conical shaped wall section 32 and the projection of the adjacent circular lower edge of frusto-conical shaped core 65, is traversed by crop engaging elements 67 and 68 which pass through a plane parallel to and substantially encompassing the ring-shaped area in the bottom 30 of the tank.

All mechanism of the grinder-mixer are adapted to be powered from the tractor (not shown) utilized to transport the machine. To this end, the grinder-mixer is provided with a forwardly extending power shaft 78 (shown in FIGS. 2 and 3 only) adapted to be interconnected with a tractor power takeoff shaft in a conventional manner. The power shaft 78 is drivingly interconnected with hammermill 33 via a belt drive, the main and auxiliary transfer auger assemblies via roller chain drives, the vertical mixing assembly via a shaft 80 coupled through a universal 81 (see FIG. 2) to gearbox 73, and the discharge auger assembly via the roller chain drive for the auxiliary transfer auger and thence through a positive engaging clutch (not shown in FIG. 1) to the rear portion of the machine.

More specifically, a driven pulley 82 on the hammermill rotor shaft 83 is driven by a belt 84 extending around drive sheave 85, mounted on a stub shaft 86. Drive connections for all powered assemblies are coupled through stub shaft 86 which is driven by power shaft 78. Fan 41 is also mounted for rotation on hammermill rotor shaft 83 and accordingly also powered by the hammermill belt drive. Stub shaft 86 drives the roller chains 87 and 88 which in turn rotatably drive shaft 80 for driving gearbox 73 and roller chain 90 which in turn drives auxiliary transfer auger 46. The main transfer auger 36 is drivingly interconnected with stub shaft 86 via roller chain 91 driven by a forward extending shaft member 92. On the rearward end of the shaft for auxiliary transfer auger 46 is a jaw clutch element of clutch 93 (see FIG. 3) whereby the shaft for horizontal discharge auger 50 may be selectively engaged. A clutch control 94 is utilized to positively engage clutch 93 by shifting shaft 95 sbout a fixed pivot support 96. Under conditions where the clutch horizontal discharge auger 50 is rotated via its shaft, which in effect becomes the drive shaft for the entire unloading assembly, i.e., it is coupled to chain drive 97 (FIG. 2) which rotates stub shaft 98 and stub shaft 100 which in turn, via bevel gearing, drive vertical discharge auger 53 and unload auger 60, respectively. Thus, the power shaft 78 drivingly interconnects the fan, hammermill, mixing assembly 28, the main transfer auger 36, the auxiliary transfer auger 48 and unloading assembly 27. In view of the conventional mechanisms involved in the various drive arrangements no further detailed description will be set forth.

Figure 4:
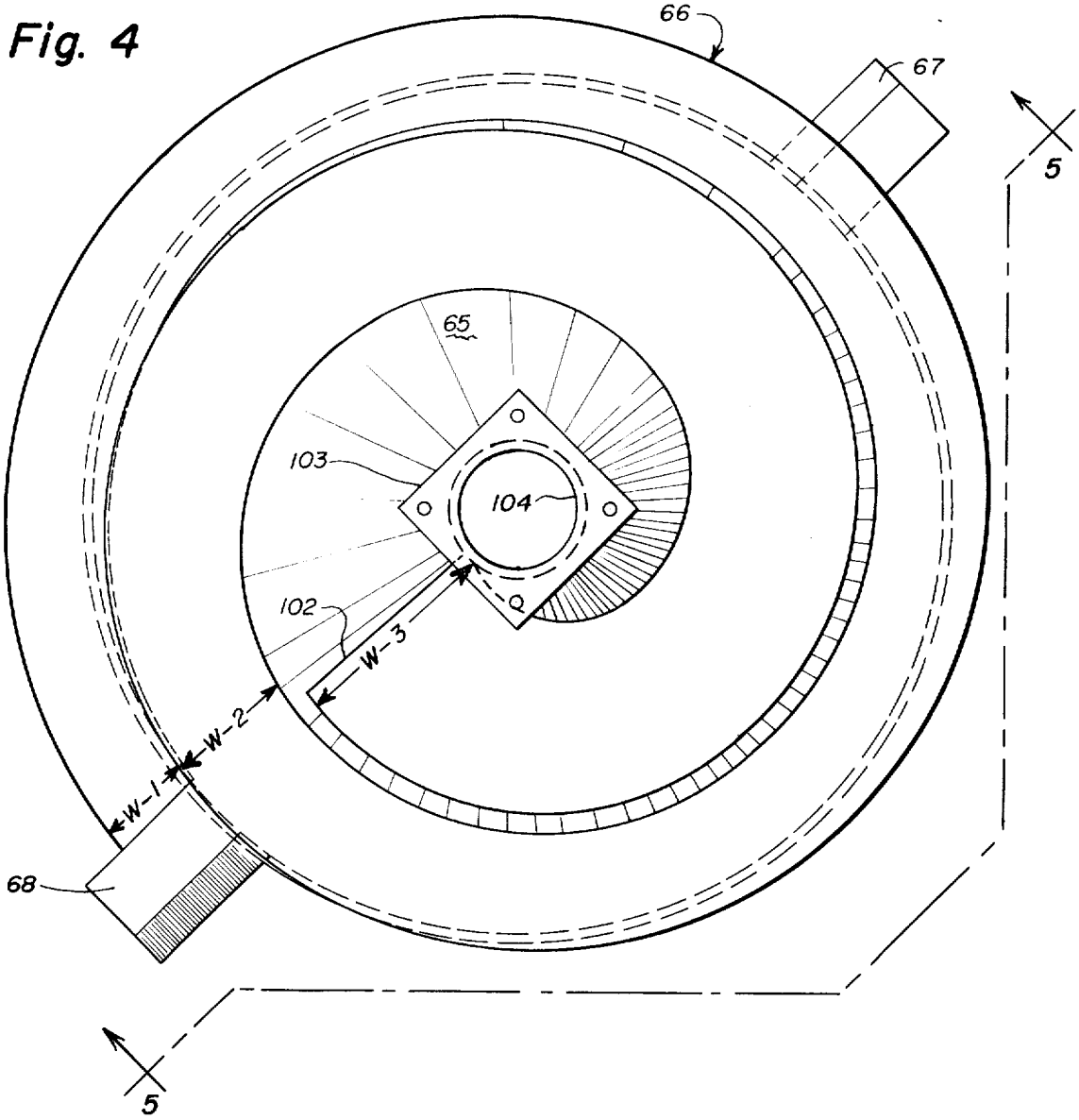
FIG. 4 is a plan view of the lower portion of the vertical mixing assembly of the grinder-mixer shown in FIG. 1.
Figure 5:
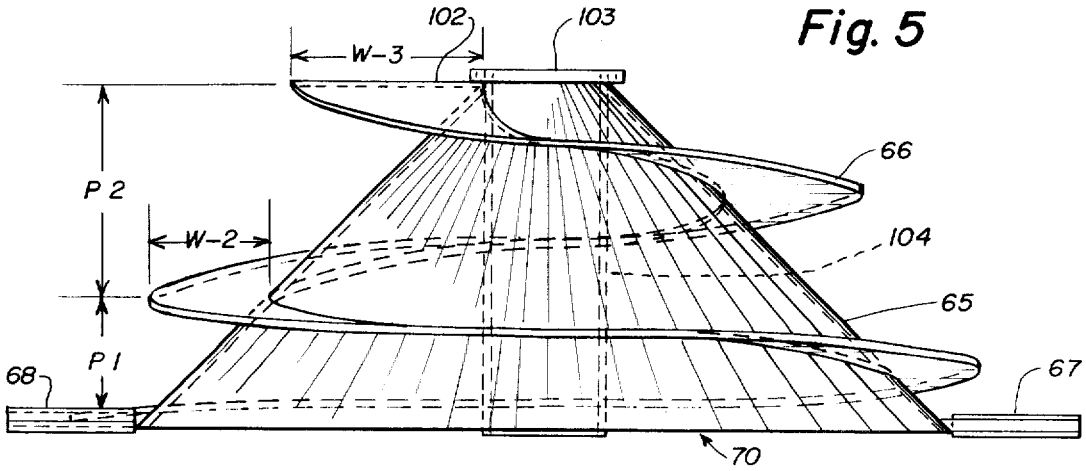
FIG. 5 is an elevational view taken along lines 5—5 of FIG. 4.

Now turning to FIGS. 4 and 5, for a more detailed description of the lower portion of the vertical mixing assembly, the specific dimensions of the unique structure of lower frusto-conical shaped core member 65 in relation to spiral flighting 66 will be noted. The width W-1 of spiral flighting 66 is narrowest at its lowermost edge where it commences at the rearward edge of rigid crop engaging element 68. The width thereof increases as flighting 66 advances upwardly about frusto-conical shaped core member 65. At the completion of one full turn the flighting width has increased to W-2 which is greater than W-1. The flighting width continues to progressively increase until it terminates at its upper edge 103 after a second full turn has been completed, whereupon it has increased to width W-3 which is greater than W-2. Width W-3 is substantially the same as the flighting width of the constant pitch spiral flighting 64 of the upper portion of the vertical mixing assembly. A collar member 103 is shown for readily connecting the lower assembly to the upper portion. Although the lower auger assembly shown in FIGS. 4 and 5 is adapted for ready removability for convenience of fabrication and servicing, the overall mixing assembly could be constructed in an integral manner without having any effect on the function of the mixing apparatus. Mounted within core member 65 is a tubular core 104 for receiving upright shaft 72 upon which the core member is affixed for rotation.

In FIG. 5, the spiral flighting is shown in elevation and illustrates the varying pitch between the two turns of flighting 66. The first turn is wound between rigid crop engaging element 68 and terminates at width W-2 with a pitch equivalent to the distance P-1. The second turn wound from the point in the flighting at W-2 to and terminating at edge 102 increases in pitch to an amount equivalent to the distance P-2. Thus, FIGS. 4 and 5 clearly illustrate an increase in pitch as the width of the flighting increases. It should be pointed out that although this embodiment of the invention contemplates the use of two full turns of flighting, other arrangements in which more or less than two turns are used need only utilize the unique principals involved to accomplish the same result. For example, in an additional full or part turn, the width would increase to an amount greater than W-3 and the pitch could be altered based on the flighting width.

In operation, a tractor is connected to main power shaft 78 to rotate stub shaft 86 which in turn drives the various mechanisms of the machine. Feed material is fed into hammermill hopper 34, processed and then conveyed via transfer auger 36 through opening 38 to the interior of the tank. Material is also fed into transfer auger 36 from tube 44 by virtue of dust collector 43 which draws air through the hammermill and reroutes suspended feed particles to the tank via pipe 42. The auxiliary transfer auger feeds material to the tank as may be desired, e.e., by means of feed concentrate hopper and auxiliary transfer auger 46, high protein additives or the like can be selectively introduced. Feed material and additives are continuously added to the tank until it is substantially full for until such time as no further material is available or desirable for introduction thereto. Materials entering through openings 38 and 48 in the tank bottom 30 are initially engaged by rigid crop engaging elements 67 and 68, and then immediately urged upwardly by virtue of spiral flighting 66 on the frusto-conical core member 65. Material is urged upwardly along flighting 66 until it reaches vertical auger housing 62 through which it is continued along its upward path until it reaches the top of vertical auger housing 62 and is discharged radially with assistance from paddle 71. The feed material then gravitates downwardly to the base of the mixing tank between the concentric circular walls of the tank and the outer surface of vertical auger housing 62. It is intermixed with incoming material being introduced into the trough-like portion of the tank whereupon the circulating material is again urged upwardly by flighting 66 at such time as it reaches the lowermost point in its circuitous path which is in the vicinity of the trough-like portion of the tank. During this mixing operation, the unloading auger assembly is deactivated by declutching positive engaging clutch 93 and opening 52 is covered by any suitable closure means (not shown) that can be slidably positioned by means of a crank arm or the like. During an unloading operation, the closure is removed from opening 52 and material is discharged via the discharge assembly described above. The vertical mixing assembly continues to rotate during a discharge operation to enhance circulation and movement of material and thereby more rapidly and completely empty mixed material from the tank. To further enhance this discharge operation, a unique relieved portion 101 in the lower section of the tank wall is cut away from frusto-conical section 32 to permit use of a larger unimpeded discharge opening and thus provide more rapid discharge of mixed material. Relief portion 101 provides three vertical wall segments defining the cut away portion of the tank sidewall in the immediate vicinity of opening 52, through which material is discharged. Thus, this unique structure does not interrupt the shape of the lower frusto-conical shaped wall section 32 to any great degree and thereby leaves substantially undisturbed the trough-like area and its attendant improved function.

More particularly, with respect to the mixing operation when material is being urged upwardly in its circuitous path by virtue of the spiral flighting on the frusto-conical core member 65, the unique flighting structure is adapted to displace a volume of material during each revolution which is closely related to the pitch and width of the flighting and while taking into direct consideration the decreasing diameter of the core member. Thus, as the pitch increases from P-1 to P-2 and the width progressively decreases from W-1 to W-2 and ultimately to W-3 the volume of material displaced is substantially uniform due to the mathematical relationships of these dimensions. While uniform volume displacement is possible by increasing the width over a constant pitch, Applicant has determined that the optimum results over a wide range of conditions can best be attained by the relationship shown.

Therefore, it is obvious that the present invention presents a simple, reliable and relatively inexpensive grinder-mixer arrangement that will effectively provide for uniform and rapid mixing while minimizing bridging. The specific improved structure provides for efficient use of the mixing assembly from the standpoint of loading as well as volume displacement. The auger operates at optimum capacity by virtue of the unique flighting arrangement which is designed to move material uniformly to the open lower portion of tubular auger housing 62. Thus, plugging is minimized and the mixing assembly is able to circulate material at a higher frequency than heretofore experienced in grinder-mixer apparatus, resulting in more rapid and improved operation.

While the preferred structure in which the principles of the present invention have been incorporated is shown and described above, it is to be understood that the invention is not to be limited to the particular details, as shown and described above, but that, in fact, widely different means may be employed in the practice of the broader aspects of the invention.

Having thus described the invention, what is claimed is:

1. In a mixing apparatus of the type including
a frame,
a tank supported by the frame, having a top, a bottom and outer wall means for confining feed material,
means for transferring material into the tank,
means for unloading material from said tank, and
a vertical assembly mounted within the tank for mixing material fed into the tank, said assembly comprising a vertical auger housing and rotatably mounted material advancing means having a first portion comprising a vertical auger positioned partly within the housing adapted to receive material and advance it upwardly through said housing and an improved second material advancing portion below and axially aligned with said first portion, for advancing material upwardly to said first portion, said second portion including
a. a core member having an outer surface converging upwardly, and
b. spiral flighting extending outwardly from said outer surface to engage materials being mixed,
c. said flighting increasing in width from its lower end to its upper end for uniformly advancing material upwardly to said first portion by maintaining the volume displaced per revolution.

2. A mixing apparatus, as set forth in claim 1, wherein said core member is frusto-conical shaped with a substantially circular lower edge adjacent the tank bottom and with a substantially circular upper edge terminating in the vicinity of the lower end of said vertical housing.

3. A mixing apparatus, as set forth in claim 2, wherein the spiral flighting of said second portion of the material advancing means is continuously wound around said outer wall from the bottom edge to the top edge to aid in the conveying of material from the bottom of the tank and intermediate points to the vertical auger housing.

4. A mixing apparatus, as set forth in claim 1, wherein the spiral flighting of said second portion of the material advancing means is wound continuously along said core member and the outer diameter thereof decreases as it is wound upwardly.

5. A mixing apparatus, as set forth in claim 4, wherein said vertical auger of the first portion of the material advancing means comprises a tubular core and flighting wound upwardly therearound, and
wherein the outer diameter of said spiral flighting of said second portion decreases to an amount substantially the same as the outer diameter of the flighting of said vertical auger of the first portion of the material advancing means.

6. A mixing apparatus, as set forth in claim 5, wherein the upper end of said spiral flighting terminates at and is radially aligned with the lower edge of the flighting of the vertical auger of said first portion.

7. A mixing apparatus, as set forth in claim 1, wherein the pitch of the spiral flighting increases as the flighting is wound upwardly.

8. A mixing apparatus of the type including
a frame,
a tank supported by the frame, having a top, a bottom and an outer wall for confining feed material, said outer wall extending between said top and said bottom and having a first cylindrical section and a second frusto-conical shaped section integral with and extending downwardly and inwardly from the cylindrical section,
means for transferring material into the tank,
means for unloading material from said tank, and
a vertical assembly mounted within the tank for mixing material fed into the tank, said assembly comprising a vertical auger housing and rotatably mounted material advancing means having a first portion comprising a vertical auger positioned partly within the housing adapted to receive material and advance it upwardly through said housing and an improved second material advancing portion below and axially aligned with said first portion for advancing material upwardly to said first portion, said second portion including a. a core member having an outer surface converging upwardly, and b. spiral flighting extending outwardly from said outer surface to engage materials being mixed, c. said flighting increasing in width from its lower end to its upper end for uniformly advancing material upwardly to said first portion by maintaining the volume displaced per revolution.

9. A mixing apparatus, as set forth in claim 8, wherein the core member is frusto-conical shaped with a substantially circular lower edge adjacent the tank bottom and a substantially circular edge terminating approximately opposite the upper edge of the frusto-conical section of the tank wall.

10. A mixing apparatus,s as set forth in claim 8, wherein the spiral flighting of said second portion of the material advancing means is wound continuously along said core member and the outer diameter thereof decreases as it is wound upwardly, said flighting terminating approximately opposite the upper edge of the frusto-conical shaped section of the tank wall.

11. A mixing apparatus, as set forth in claim 10, wherein said vertical auger of the first portion of the material advancing means comprises a tubular core and flighting wound upwardly therearound, and wherein the outer diameter of said spiral flighting of said second portion decreases to an amount substantially the same as the outer diameter of the flighting of said vertical auger of the first portion of the material advancing means.

12. A mixing apparatus, as set forth in claim 11, wherein the upper end of said spiral flighting terminates at and is radially aligned with the lower edge of the flighting of the vertical auger of said first portion.

13. A mixing apparatus, as set forth in claim 9, wherein a plane through the upper edge of said frusto-conical section of the tank is a distance above said bottom of less than approximately one-fourth the axial distance between said bottom and said top.

* * * * *